US010314441B2

(12) United States Patent
Kratzmann et al.

(10) Patent No.: US 10,314,441 B2
(45) Date of Patent: Jun. 11, 2019

(54) SHOWER HOB APPARATUS

(71) Applicants: Jude Kratzmann, Murrumba Downs, Queensland (AU); Kelly Mansbridge, Biggera Waters, Queensland (AU)

(72) Inventors: Bruce Kratzmann, Murrumba Downs (AU); Nick Mansbridge, Biggera Waters (AU)

(73) Assignees: Jude Kratzmann, Murrumba Downs, Queensland (AU); Kelly Mansbridge, Biggera Waters, Queensland (AU)

( * ) Notice: Subject to any disclaimer, the term of this patent is extended or adjusted under 35 U.S.C. 154(b) by 20 days.

(21) Appl. No.: 15/030,997

(22) PCT Filed: Oct. 21, 2014

(86) PCT No.: PCT/AU2014/000991

§ 371 (c)(1),
(2) Date: Apr. 21, 2016

(87) PCT Pub. No.: WO2015/058238

PCT Pub. Date: Apr. 30, 2015

(65) Prior Publication Data

US 2016/0262576 A1 Sep. 15, 2016

(30) Foreign Application Priority Data

Oct. 21, 2013 (AU) ..... 2013904058

(51) Int. Cl.

| | |
|---|---|
| ***A47K 3/40*** | (2006.01) |
| ***E04F 19/06*** | (2006.01) |
| ***A47K 3/30*** | (2006.01) |

(52) U.S. Cl.
CPC ..... *A47K 3/302* (2013.01); *A47K 3/30* (2013.01); *A47K 3/40* (2013.01); *E04F 19/061* (2013.01); *A47K 2003/305* (2013.01)

(58) Field of Classification Search
CPC ..... A47K 3/008; A47K 3/40
USPC ..... 4/612–614; 52/27, 35, 36.5, 302.6, 846
See application file for complete search history.

(56) References Cited

U.S. PATENT DOCUMENTS

| | | | | |
|---|---|---|---|---|
| 6,293,064 B1 * | 9/2001 | Larson | E04B 1/762 52/209 |
| 2006/0195980 A1 * | 9/2006 | Nagley | A47K 3/008 4/595 |
| 2007/0193201 A1 * | 8/2007 | Cowling | A47K 3/40 52/846 |

(Continued)

FOREIGN PATENT DOCUMENTS

| | | |
|---|---|---|
| AU | 52184/93 | 6/1994 |
| AU | 2005232332 B2 | 9/2010 |

*Primary Examiner* — Christine J Skubinna
(74) *Attorney, Agent, or Firm* — Schwabe Williamson & Wyatt, P.C.

(57) ABSTRACT

The invention includes a shower hob apparatus, a method of constructing a shower hob, and a shower hob, for at least one side of a shower cubicle. The shower hob apparatus includes a base portion and a screen retaining portion. The base portion is affixed to a floor surface and has a waterproof layer applied thereon. Tile bedding and tiles may then be constructed on top of the base portion. The resultant shower hob is formed as part of a tiled floor, and provides a relatively strong and low profile shower hob compared to previous shower hobs.

18 Claims, 3 Drawing Sheets

(56) References Cited

U.S. PATENT DOCUMENTS

2010/0154112 A1* 6/2010 Goodhue ..... A47K 3/008
4/613

* cited by examiner

SHOWER HOB APPARATUS

FIELD OF THE INVENTION

The invention relates to shower construction. In particular, the invention relates, but is not limited, to an apparatus used in the construction of a shower hob.

BACKGROUND TO THE INVENTION

Reference to background art herein is not to be construed as an admission that such art constitutes common general knowledge in Australia or elsewhere.

Showers hobs are traditionally constructed around the perimeter of a shower cubicle to confine water and prevent leakage. Hobs are commonly constructed of aerated concrete blocks or bricks which are affixed to the floor. Waterproofing and bedding compounds are applied to the inside of the hob and bathroom tiles are affixed on top. Shower trays can also be fitted over the hob. A shower screen is commonly sealed directly to the tiles or the shower tray.

One problem with traditional shower hob constructions is that, as tile grout is porous, water can seep between the tiles. This can result in the tiles detaching from the hob, disintegration of the waterproof layer, and damage to the surrounding floor or walls.

Another problem is that the concrete blocks or bricks are generally quite wide and this results in a large step into the shower cubicle. Apart from being unappealing to the eye, this can be a safety hazard.

Another disadvantage of traditional shower hob construction is that the process of constructing the shower hob can take days to complete. The concrete blocks or bricks must be adhered to the floor before the waterproofing membrane can be applied, and the waterproofing must be dry before the bedding can be laid. The tiles cannot be grouted until the tile adhesive has set and the shower screen cannot be installed until the tiles are laid.

Modern shower hobs may be constructed using aluminium angle rather than concrete blocks or bricks. Once the angle is affixed to the floor, the waterproofing and bedding compounds are applied over the angle and the inside of the shower hob. The tiles must then be laid, set and grouted, prior to the installation of the shower screen. Whilst this type of construction may reduce water leakage and decrease the size of the step into the shower cubicle, the shower hob must still be constructed in a step-wise process and the shower screen cannot be installed until the waterproofing, bedding and tiling steps are completed.

OBJECT OF THE INVENTION

It is an aim of this invention to provide a shower hob apparatus which overcomes or ameliorates one or more of the disadvantages or problems described above, or which at least provides a useful alternative.

Other preferred objects of the present invention will become apparent from the following description.

SUMMARY OF THE INVENTION

Throughout the specification, the term "screen" shall be taken to include glass screens and panels, and screens and panels made from other materials such as Perspex, plastics, metal, or the like.

In one form, although it need not be the only or indeed the broadest form, there is provided a shower hob apparatus for forming a shower hob including:

a screen retaining portion adapted to receive a screen, the screen retaining portion having at least one side wall; and a base adapted to engage with a floor surface;

wherein the base extends laterally to the side wall of the screen retaining portion.

Preferably, the screen retaining portion is in the form of a channel. More preferably, the channel includes a floor and two side walls extending substantially perpendicular to the floor of the channel to form a substantially U-shaped channel. Preferably, the side wall or walls abut a screen. The screen retaining portion may have a drainage hole. Preferably the drainage hole is located in the floor of the channel.

Preferably, the base is substantially planar having an upper and lower surface. In a preferred form, the lower surface of the base is fixed to the floor surface by the use of an adhesive or the like.

Alternatively, the base may be fixed to the floor surface by the use of one or more fasteners. Preferably, the base includes a groove on the upper surface which indicates a preferred position for making at least one aperture and inserting at least one fastener, such as a screw, to fix the base to the floor surface. Suitably, the groove may be a weakened portion of the shower hob apparatus such that it is relatively easy for a user to form an aperture in the groove with the appropriate tool, such as a self-tapping screw or a drill. The groove is preferably sized and shaped to allow the screw to be at least partially countersunk in the base.

Preferably, a free end of the base is tapered to assist in the application of a waterproof layer. More preferably, the free end of the base is tapered at an angle of 45 degrees or less, relative to a longitudinal axis of the base.

In a preferred form, the shower hob apparatus includes a tile height indicator.

The tile height indicator preferably includes a tile support member extending laterally to a side wall of the screen retaining portion. The tile height indicator is preferably adapted to receive a tile.

Alternatively, the tile height indicator may be in the form of a mark or notch on the shower hob apparatus for indicating a preferred tile position.

Preferably, the tile height indicator is lower than the screen retaining portion. More preferably, the tile height indicator is lower than the floor of the screen retaining portion.

In a preferred form, the shower hob apparatus includes at least one longitudinal member which forms a connection between the base and the screen retaining portion. In a preferred form a single longitudinal member forms a connection between the base and the screen retaining portion. Preferably the longitudinal member, the base, and the screen retaining portion collectively define a cavity. In another preferred form the shower hob apparatus may include two longitudinal members, located between the base and the screen retaining portion. The two longitudinal members preferably define a hollow interior.

The base preferably extends laterally from an end of a longitudinal member. The screen retaining portion is preferably located at an opposite end of the longitudinal member, distal to the base.

The longitudinal member(s), base and screen retaining portion are preferably integrally formed as an extrusion.

Preferably, the tile height indicator extends laterally from a longitudinal member or a side wall of the screen retaining portion of the shower hob apparatus.

According to another form of the invention, there is provided a shower hob comprising the shower hob apparatus as hereinbefore described with a waterproof layer, a bedding layer, and a tiled surface arranged on top of the base. Preferably the shower hob further comprises a screen affixed in the screen retaining portion.

According to another form of the invention there is provided a method of constructing at least a portion of a shower cubicle using a shower hob apparatus as herein described, the method including the steps of:

fixing at least one shower hob apparatus to a floor surface;

inserting a screen into the screen retaining portion of the shower hob apparatus;

applying a waterproof layer over the floor surface and at least a portion of the base of the shower hob apparatus; and constructing a tiled floor over the waterproof layer.

According to yet another form of the invention there is provided a method of constructing at least a portion of a shower cubicle, the method including the steps of:

fixing a base of at least one shower hob apparatus to a floor surface;

inserting a screen into a screen retaining portion of the shower hob apparatus;

applying a waterproof layer over the floor surface and at least a portion of the base of the shower hob apparatus; and constructing a tiled floor over the waterproof layer.

Preferably, the step of constructing the tiled floor includes applying a bedding layer over the waterproof layer, and applying tiles over the bedding layer.

Preferably, the bedding layer is applied to a level indicated by a tile height indicator on the shower hob apparatus. The tile height indicator may be a mark or notch on the shower hob apparatus.

The tile height indicator may also be a tile support member. Preferably, one or more tiles overlie the tile support member which extends from a longitudinal member of the shower hob apparatus. The tiles are preferably laid on an incline towards a drain in the shower cubicle.

Preferably, the step of fixing the shower hob apparatus to the floor surface includes applying an adhesive to the base of the shower hob apparatus. Alternatively, the base of the shower hob apparatus may be fixed to the floor by at least one fastener such as a screw. One or more apertures may be made in the groove of the base of the shower hob apparatus to receive the screw or screws.

The shower hob apparatus and screen preferably form at least one side of the shower cubicle.

According to yet another form of the invention there is provided a shower cubicle including:

a shower hob apparatus fixed to a floor surface, the shower hob apparatus including a screen retaining portion having at least one side wall, and a base extending laterally to the side wall of the screen retaining portion;

a screen inserted into the screen retaining portion of the shower hob apparatus;

a waterproof layer located over the floor surface and at least a portion of the base of the shower hob apparatus;

a bedding layer located over the waterproof layer;

a tiled surface located over the bedding layer, wherein the tiled surface slopes down from the shower hob apparatus towards a drain;

wherein, the shower hob apparatus defines one or more sides of the shower cubicle.

Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures, wherein.

DETAILED DESCRIPTION OF THE INVENTION

Figure 1:
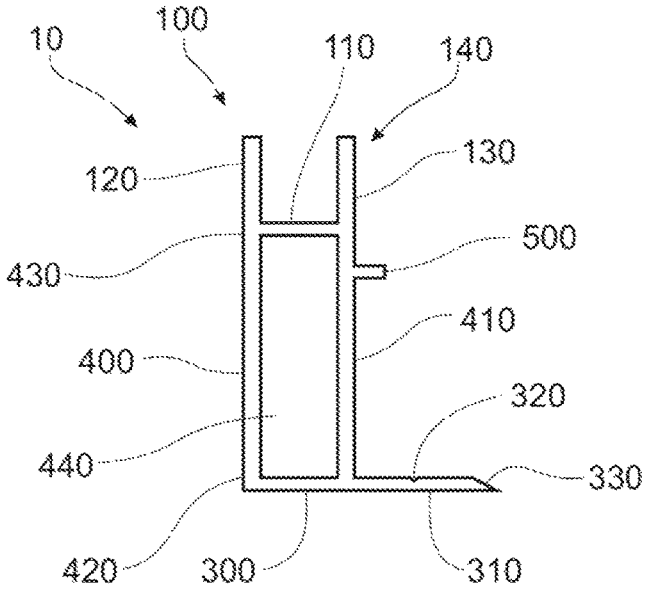
FIG. 1 is an end view of a shower hob apparatus according to an embodiment of the invention.
Figure 2:
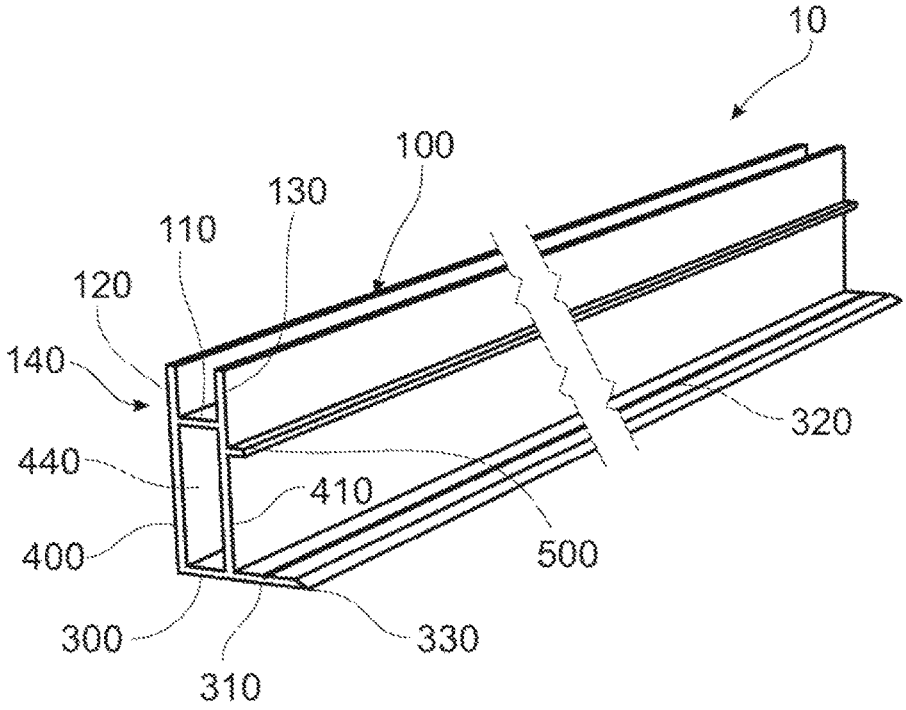
FIG. 2 is a top perspective view of the shower hob apparatus illustrated in FIG. 1.
Figure 3:
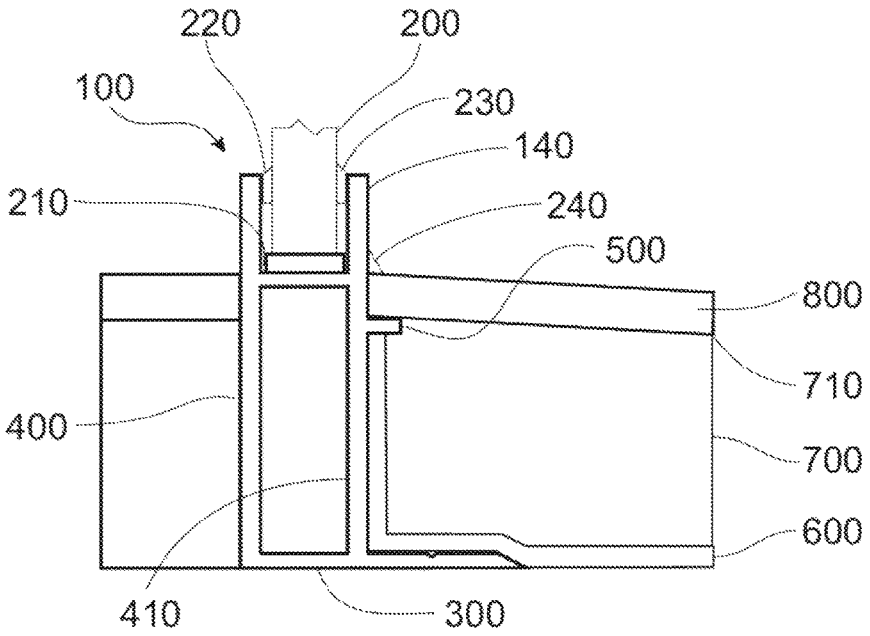
FIG. 3 is a cross section of a shower hob according to an embodiment of the invention.

FIGS. 1 to 3 illustrate a shower hob apparatus 10 having a screen retaining portion 100 for receiving a screen 200 (see FIG. 3). The screen retaining portion 100 includes a floor 110 and two side walls 120, 130 extending vertically to form a substantially U-shaped channel 140.

The shower hob apparatus 10 also includes a base 300 which extends laterally to the side wall 130 of the screen retaining portion 100. The base 300 has a planar portion 310 which can be fixed to a floor surface (not shown), such as concrete or wooden floor boards, by an adhesive. The base 300 may also be fixed to a floor surface by at least one fastener such as a screw. The groove 320 on the upper surface of the base 300 provides an indicator for the optimal position of one or more apertures for receiving one or more screws.

The base may also include grooves or notches on the lower surface of the planar portion 310 for adhering the base 300 to the floor surface. One end of the base 330 is tapered to a point which assists in the application of the waterproof layer 600, as described below.

In a preferred embodiment, the shower hob apparatus 10 also includes two longitudinal members 400, 410 which connect the base 300 and the screen retaining portion 100. As shown in FIGS. 1 to 3, the base 300 is located at one end 420 of the longitudinal member 400 and the screen retaining portion 100 is located at another end 430 of the longitudinal member 400, distal to the base 300.

The two longitudinal members 400, 410 preferably define a hollow interior 440. The base 300 preferably extends laterally from a longitudinal member 410, such that the base 300 and the longitudinal members 400, 410 together form a substantially L-shaped member.

As shown in FIG. 2, the longitudinal members 400, 410, base 300 and channel 140 of the screen retaining portion 100 are integrally formed as an extrusion. The extrusion can be any suitable length. Advantageously, the height and width of the shower hob apparatus 10 can also be varied to suit different applications.

FIGS. 1 to 3 illustrate a shower hob apparatus 10 having a tile height indicator in the form of a tile support member 500. The tile support member 500 preferably extends laterally from longitudinal member 410 of the shower hob apparatus 10. As shown in FIGS. 1 to 3, the tile support member 500 is positioned lower than the channel 140 of the screen retaining portion 100.

In an alternative embodiment, the tile height indicator may be a mark or notch (not shown) on longitudinal member 410 for indicating the preferred level of the bedding layer 700 and position of the tiles, as described below.

FIG. 3 shows a portion of a shower hob constructed according to an embodiment of the invention. The shower hob includes a shower hob apparatus 10, a waterproof layer 600, a bedding layer 700, and tiles 800. A screen 200 has been installed into the screen retaining portion 100 of the shower hob apparatus 10 such that the screen 200 is in an upright position.

Figure 6:
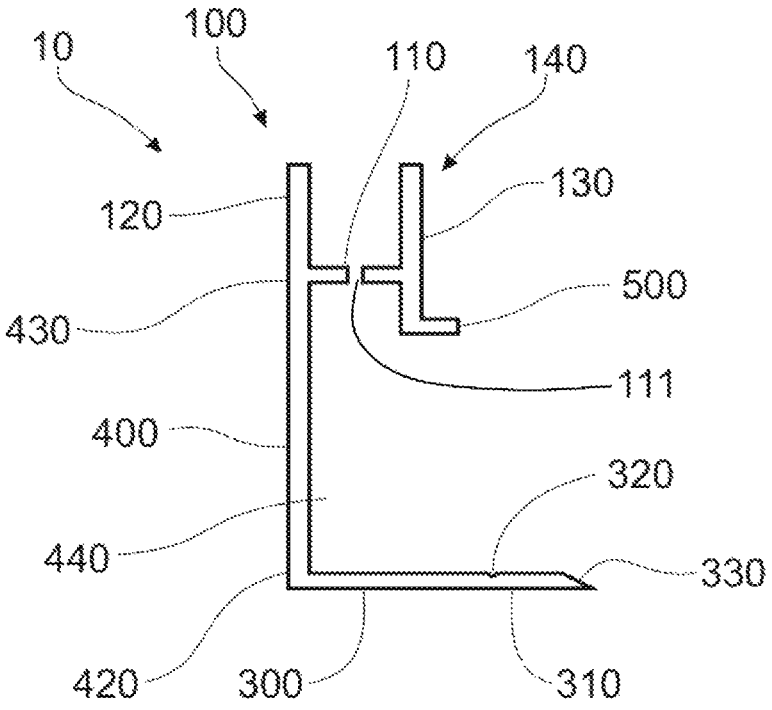
FIG. 6 is a cross section of a shower hob according to another embodiment of the invention.

In an alternative form, as illustrated in FIG. 6, the shower hob apparatus 10 includes a single longitudinal member 400. Compared to the shower hob apparatus 10 illustrated in FIGS. 1 to 3, the second longitudinal member 410 has been removed. In such an embodiment the hollow interior 440 (illustrated in FIG. 1) effectively becomes a cavity 440 (illustrated in FIG. 6). The cavity 440 may receive the waterproof layer 600 and bedding layer 700 illustrated in FIG. 3. It is preferred that the waterproof layer 600 extends at least partially up the inner side of the longitudinal member 400.

Also illustrated in FIG. 6 is an optional drainage hole 111 located in floor 110 of the screen retaining portion 100. The drainage hole 111 fluidly connects the screen retaining portion 100 to the cavity 440 to communicate any liquid that may reach the screen retaining portion 100 into the cavity 440. It will be appreciated that although the drainage hole 111 is only illustrated in relation to the embodiment of the show hob apparatus illustrated in FIG. 6, that it could be provided in relation to other embodiments, including the embodiment illustrated in FIGS. 1 to 3.

In use, the base 300 of the shower hob apparatus 10 is fixed to a concrete slab or other floor surface, preferably using an adhesive. The base 300 may also be fixed to the floor surface by at least one fastener such as a screw. The groove 320 on the upper surface of the base 300 provides an indicator for the preferred location of the aperture or apertures for receiving one or more screws to fix the base 300 to the floor surface. As shown in FIGS. 1, 3, and 6, the groove 320 is a substantially v-shaped recess in the base 300 of the shower hob apparatus 10. Due to the size and shape of the groove 320, the screw (not shown), once inserted into the aperture (not shown) in the groove 320, will be at least partially countersunk in the base 300.

It is preferred that the shower hob apparatus 10 is level once fixed to the floor surface, and packers can be used if necessary to level the shower hob apparatus 10. Wall channels (not shown) can also be fitted to the floor surface adjacent the wall or walls of the shower cubicle. An infill channel (not shown) can also be fitted to the floor surface to form a doorsill.

When fixed to a floor surface, the shower hob apparatus 10 is rigid and provides support for a screen 200 which is inserted into the channel 140 of the screen retaining portion 100 to form at least a portion of a shower cubicle. To ensure the screen 200 is firmly secured in the channel 140, packers 210 can be inserted underneath and behind the screen 200. Preferably, the screen 200 abuts the side wall 130 of the shower hob apparatus 10. Any gaps between the screen 200, the shower hob apparatus 10, and the wall channel (not shown) can be filled with silicone 220, 230, 240 or other suitable sealant. Silicone, or another suitable sealant, can also be used to fill gaps between the wall channel (not shown) and the shower hob apparatus 10.

A waterproof layer 600 is then applied over the floor surface and a portion of the shower hob apparatus 10, preferably the base 300. The waterproof layer 600 can be formed from a liquid waterproofing material, a fibreglass membrane, or any other suitable waterproofing agent. As shown in FIG. 3, it is preferred that the waterproof layer 600 is applied up to the tile support member 500. However, it will be appreciated that it is not essential for the waterproof layer 600 to be applied to this level. For example, the waterproof layer 600 could even be applied over the tile support member 500 up to the channel 140 of the screen retaining portion 100. One end 330 of the base 300 tapers off towards the floor surface which assists in the application of the waterproof layer 600. As shown in FIGS. 1, 3, and 6, the tapered end 330 of the base 300 is tapered at an angle of 45 degrees or less, relative to a longitudinal axis of the base 300.

Once the waterproof layer 600 has been applied, a bedding layer 700 is applied over the waterproof layer 600 and up to the level indicated by the tile support member 500. The bedding layer may be comprised of mortar, cement and sand mix, or any other suitable material. Tiles 800 are then applied to the surface 710 of the bedding layer 700, using the tile support member 500 as a guide for positioning the tiles 800 which abut the shower hob apparatus 10. The tile support member 500 is preferably located below the screen retaining portion 100, such that the tiles 800 once laid, are roughly aligned with the floor 110 of the channel 140 of the screen retaining portion 100.

It will be appreciated that the bedding layer 700 and tiles 800 will typically be laid around a drain (not shown) in the floor of the shower cubicle. Persons skilled in the art will also appreciate that the tiles 800 are typically laid on an incline towards the drain to allow for proper drainage of water.

Figure 4:
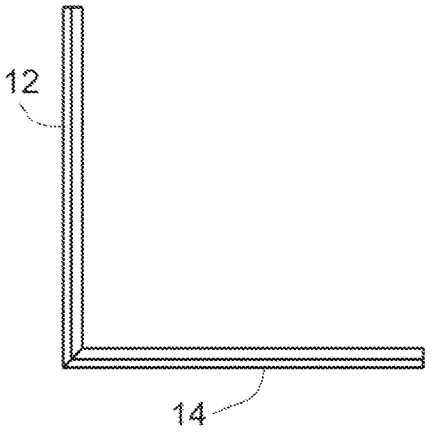
FIG. 4 is a plan view of two sections of shower hob apparatus joined to form two sides of a shower cubicle.
Figure 5:
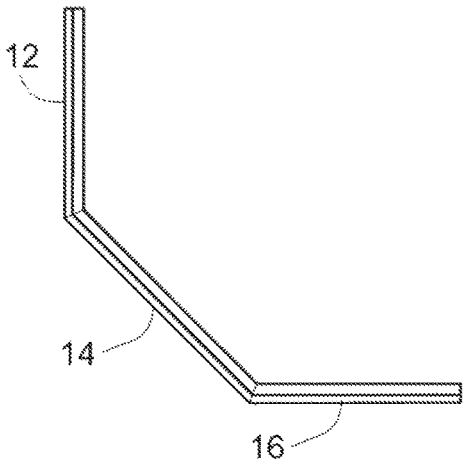
FIG. 5 is a plan view of three sections of shower hob apparatus joined to form three sides of a shower cubicle.

The shower hob apparatus 10 and screen 200 preferably form at least one side of the shower cubicle. As shown in FIGS. 4 and 5, sections of shower hob apparatus 12, 14, 16 can be joined, for example by bending and welding, to form two or more sides of the shower hob. FIG. 4 illustrates a two sided shower hob, constructed by joining two sections of shower hob apparatus. FIG. 5 illustrates a three sided shower hob, constructed by joining three sections of shower hob apparatus.

Importantly, as the screen 200 is installed directly onto the shower hob apparatus 10, rather than mounted over or on the tiles 800, the screen 200 can be installed at any time during the construction process. There is no need to wait until the shower hob 10 has been waterproofed, bedded and tiled before installing the screen. For example, the screen 200 can be installed as soon as the shower hob apparatus 10 is fixed in position, after the waterproof layer 600 is applied, or even after the entire tiling process. The result is a more streamlined construction process and reduced labour costs.

The shower hob apparatus 10 of the present invention is much more compact than bricks or aerated concrete blocks and thus the resultant step into the shower cubicle can be much smaller than conventional shower hobs. Further, use of the shower hob apparatus 10 reduces the risk of water leakage as water cannot penetrate the shower hob apparatus 10.

The tile support member 500 provides an easy reference point for positioning the tiles 800 and the indicating the optimal depth of the bedding layer 700. Another advantage of the present invention is that the tiles 800 can be applied directly to the outer side of the shower hob apparatus 10 which reduces bedding costs.

Advantageously, the shower hob apparatus 10 of the present invention can be made from one piece which provides a strong foundation for constructing the shower hob and supporting the screen 200. Rather than affixing the screen 200 to the tiles or the shower tray, the screen 200 is installed directly into the shower hob apparatus 10 itself. This results in greater stability than prior art shower hob construction. Prior art apparatuses generally require more parts which may result in decreased stability of the shower hob, and thus the constructed shower cubicle, with increased labour and material costs.

Yet another advantage of the present invention is that the tapered end 330 of the base 300 provides a smooth transition from the floor surface to the shower hob apparatus 10. This provides a relatively smooth surface which can assist in the application of the waterproof layer 600. The tapered end 330 reduces the risk of a waterproof membrane catching and tearing on a sharp, raised end of a shower hob apparatus. The tapered end also reduces the risk of a user inconsistently applying a liquid waterproofing material to the shower hob apparatus, as the waterproofing material can be applied in a single smooth motion, rather than up and over a sharp, raised end.

The size and shape of the groove 320 of the base 300 offers another advantage. As the groove 320 is recessed into the base 300, the screw, once inserted into the aperture in the groove 320, will be partially countersunk in the base 300. The countersinking of the screw reduces the risk of the waterproof layer 600, in the form of a waterproof membrane, catching and tearing on a raised screw. It may also reduce the risk of a user inconsistently applying a liquid waterproofing material to the shower hob apparatus as the waterproofing material can be applied in a single smooth motion, rather than up and over a raised screw.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

The invention claimed is:

1. A shower hob apparatus for forming a shower hob, including:

a screen retaining portion in the form of a channel adapted to receive a screen, the screen retaining portion having at least one side wall;

a tile support member; and a base adapted to engage with a floor surface;

wherein the base and the tile support member are integrally formed with the screen retaining portion and the base extends laterally to the at least one side wall of the screen retaining portion.

2. The shower hob apparatus of claim 1, wherein the channel includes a floor and two side walls extending substantially perpendicular to the floor of the channel to form a substantially U-shaped channel.

3. The shower hob apparatus of claim 1, wherein the screen retaining portion has a drainage hole.

4. The shower hob apparatus of claim 1, wherein the base is substantially planar.

5. The shower hob apparatus of claim 1, wherein the base includes a groove on an upper surface.

6. The shower hob apparatus of claim 5, wherein the groove is a weakened portion of the shower hob apparatus that is sized and shaped to allow a screw to be inserted therethrough and countersunk in the base.

7. The shower hob apparatus of claim 1, wherein a free end of the base is tapered.

8. The shower hob apparatus of claim 7, wherein the free end of the base is tapered at an angle of approximately 45 degrees or less, relative to a longitudinal axis of the base.

9. The shower hob apparatus of claim 1, further comprising a tile height indicator.

10. The shower hob apparatus of claim 9, wherein the tile height indicator includes the tile support member.

11. The shower hob apparatus of claim 9, wherein the tile height indicator includes a mark or notch on the shower hob apparatus.

12. The shower hob apparatus of claim 9, wherein the tile height indicator is lower than the screen retaining portion.

13. The shower hob apparatus of claim 1, further comprising at least one longitudinal member which forms a connection between the base and the screen retaining portion.

14. The shower hob apparatus of claim 13, wherein a single longitudinal member forms a connection between the base and the screen retaining portion.

15. The shower hob apparatus of claim 14, wherein the longitudinal member, the base, and the screen retaining portion collectively define a cavity.

16. A shower hob comprising:

the shower hob apparatus as claimed in claim 1;

with a waterproof layer, a bedding layer, and a tiled surface arranged on top of the base.

17. The shower hob of claim 16, further comprising a screen affixed in the screen retaining portion.

18. A shower cubicle including:

a shower hob apparatus fixed to a floor surface, the shower hob apparatus including a screen retaining portion in the form of a channel and having at least one side wall, a tile support member, and a base, wherein the base and the tile support member are integrally formed with the screen retaining portion, the base extending laterally to the at least one side wall of the screen retaining portion;

a screen inserted into the screen retaining portion of the shower hob apparatus;

a waterproof layer located over the floor surface and at least a portion of the base of the shower hob apparatus;

a bedding layer located over the waterproof layer;

a tiled surface located over the bedding layer, wherein the tiled surface slopes down from the shower hob apparatus towards a drain; and wherein, the shower hob apparatus defines one or more sides of the shower cubicle.

* * * * *